US008250707B2

(12) United States Patent
Donoho

(10) Patent No.: US 8,250,707 B2
(45) Date of Patent: Aug. 28, 2012

(54) DOOR HINGE ASSEMBLY WITH INTERMEDIATE STOP POSITION

(75) Inventor: Joseph A. Donoho, Springfield, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 605 days.

(21) Appl. No.: 12/400,926

(22) Filed: Mar. 10, 2009

(65) Prior Publication Data

US 2010/0229344 A1 Sep. 16, 2010

(51) Int. Cl.
*E05F 1/08* (2006.01)

(52) U.S. Cl. ..... 16/286; 16/297

(58) Field of Classification Search ..... 16/286, 16/297, 333, 343, 289, 292; 312/326; 49/386; 126/191, 194

See application file for complete search history.

(56) References Cited

U.S. PATENT DOCUMENTS

| | | | | |
|---|---|---|---|---|
| 2,425,365 A | | 8/1947 | Davidson | |
| 2,731,011 A | | 1/1956 | Maier | |
| 2,823,662 A | | 2/1958 | Aylor | |
| 3,155,088 A | * | 11/1964 | Barber | 126/191 |
| 3,191,217 A | * | 6/1965 | Squire | 16/289 |
| 3,250,267 A | * | 5/1966 | Fry | 126/191 |
| 3,398,735 A | * | 8/1968 | Barber | 126/191 |
| 3,495,582 A | | 2/1970 | Maier | |
| 4,163,344 A | | 8/1979 | Scherer | |
| 4,665,892 A | | 5/1987 | Spargo et al. | |
| 5,291,634 A | * | 3/1994 | Zanetti | 16/333 |
| 5,341,542 A | * | 8/1994 | Hannan et al. | 16/289 |
| 6,539,581 B1 | * | 4/2003 | Faringosi | 16/327 |
| 6,968,597 B2 | | 11/2005 | Habegger et al. | |
| 7,017,232 B1 | | 3/2006 | Priddy | |

FOREIGN PATENT DOCUMENTS

CN 201306076 Y * 9/2009

* cited by examiner

*Primary Examiner* — William L. Miller
(74) *Attorney, Agent, or Firm* — Pearne & Gordon LLP

(57) ABSTRACT

A hinge assembly includes a housing member, a lever member, a traveling member and a biasing member. The housing member includes a channel and a pivot. The lever member includes an outer portion, an inner portion, and a first intermediate point located therebetween. The lever member is pivotally coupled to the pivot at the first intermediate point. The traveling member includes a main portion that is configured to extend substantially along the housing member. A second intermediate point is located on the main portion, and the inner portion of the lever member is pivotally coupled to the second intermediate point. The main portion includes a sliding block and at least one grooved wheel at an end. The sliding block is configured to travel the channel sliding between the side walls, and at least one of the sidewalls includes a rail area for the at least wheel to roll against.

21 Claims, 4 Drawing Sheets

DOOR HINGE ASSEMBLY WITH INTERMEDIATE STOP POSITION

FIELD OF THE INVENTION

The present invention relates generally to hinge assemblies, and more particularly, to hinge assemblies for appliance doors.

BACKGROUND OF THE INVENTION

Hinge assemblies for doors in appliances such as ovens have various structures the differences of which can result in a number of advantages and drawbacks in terms of operability, reliability, durability, feel, etc. For example, a door may provide an intermediate position between a fully closed position and a fully opened position that may be helpful when using the appliance. However, such a door may also encounter problems when transitioning between multiple positions in that the movement may not be smooth and may require more force than desired. Also, a hinge assembly structure provided to overcome the former problem may not maintain the intermediate position as intended. Thus, there is a need to provide a hinge assembly structure that is an improvement over the existing structures while providing a solution to known problems.

BRIEF SUMMARY OF THE INVENTION

In accordance with one aspect of the present invention, a hinge assembly is provided for a door enclosing a compartment. The hinge assembly includes a housing member configured to be mounted in a compartment, the housing member including a front wall and two side walls extending rearward from the front wall, the front wall and the side walls defining a channel, the housing member further including a top end and a bottom end; a traveling member configured to extend substantially along the housing member, wherein the traveling member includes a sliding block and at least one wheel at a first end, the sliding block configured to travel the channel sliding between the side walls, at least one of the sidewalls including a rail area for the at least wheel to roll against; and a biasing element extending between a second end of the arm portion and the bottom end of the housing member.

In accordance with another aspect of the present invention, a hinge assembly for a door enclosing a compartment is provided. The hinge assembly includes a housing member configured to be mounted in a compartment, the housing member including a front wall and two side walls extending rearward from the front wall, the housing member further including a top end and a bottom end, the front wall and the side walls defining a channel, the front wall including an aperture near the top end, the housing member further including a pivot projecting forward from the aperture; a lever member including an outer portion and an inner portion, a first intermediate point located between the outer portion and the inner portion, the lever member pivotally coupled to the pivot at the first intermediate point, the outer portion configured to be mounted on a door and transmit the movement of a door to the hinge assembly; a traveling member including a main portion and an arm portion, the main portion configured to extend substantially along the housing member, the main portion including a first end, the arm portion including a second end, a second intermediate point located on the main portion, the inner portion of the lever member pivotally coupled to the second intermediate point, the main portion including at least a wheel at the first end, at least one of the sidewalls including a rail area for the at least wheel to roll against, the rail area defined by a cammed portion of the side walls with a height lower than adjacent portions; and a biasing element extending between a second end of the arm portion and the bottom end of the housing member.

In accordance with yet another aspect of the present invention, a hinge assembly for a door enclosing a compartment includes a housing member configured to be mounted in a compartment, the housing member including a front wall and two side walls extending rearward from the front wall, the housing member further including a first end and a second end, the front wall and the side walls defining a channel; a lever member pivotally coupled to the housing member and configured to transmit the movement of a door to the hinge assembly; a traveling member including a main portion and an arm portion, the main portion configured to extend substantially along the housing member, the main portion including a third end, the arm portion including a fourth end, a second intermediate point located on the main portion, the inner portion of the lever member pivotally coupled to the second intermediate point, the main portion including a sliding block and a pair of wheels at the third end, the sliding block configured to travel the channel sliding between the side walls, each of the sidewalls including a rail area for each of the wheels to roll against; and a biasing element extending between a fourth end of the arm portion and the second end of the housing member.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
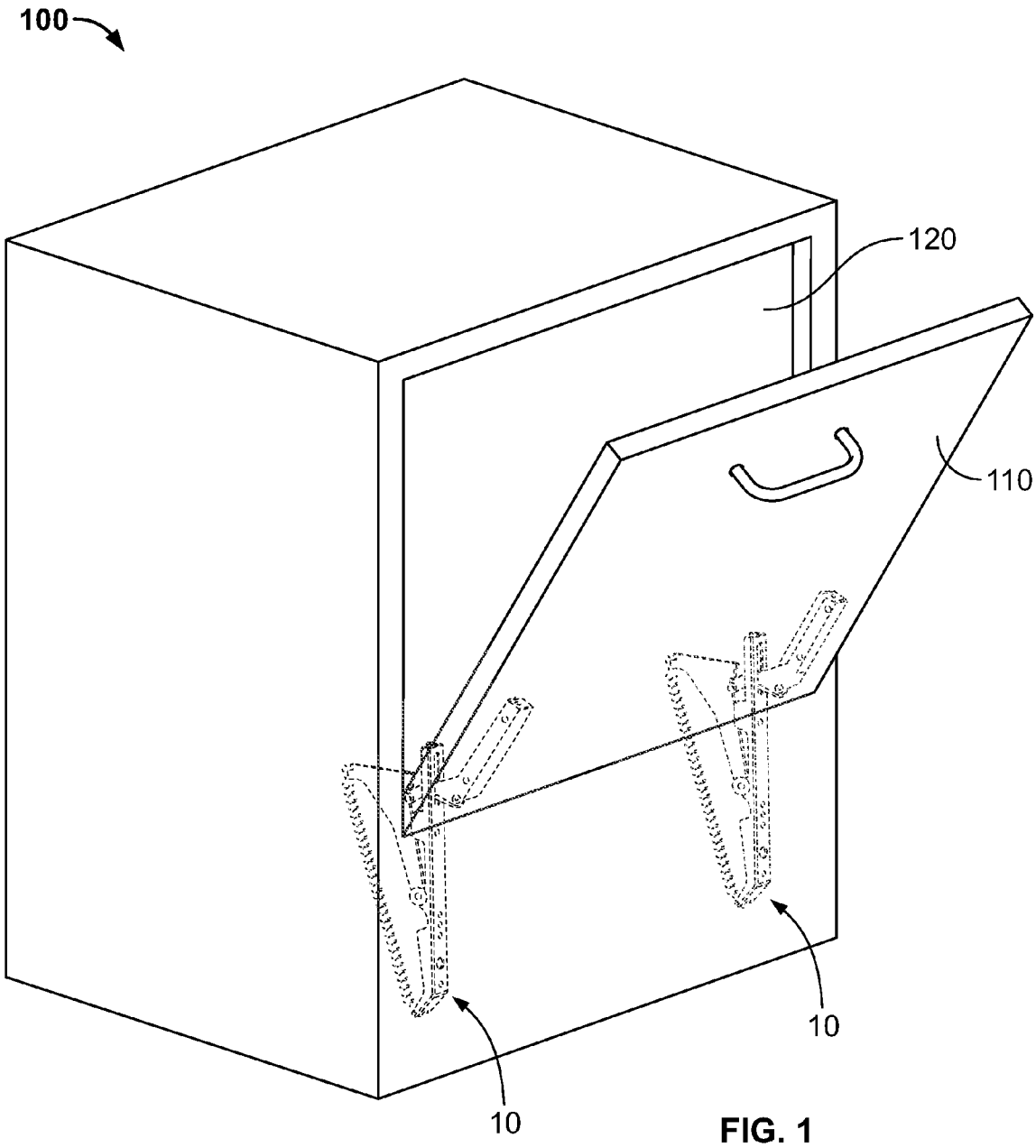
FIG. 1 is an illustration of an example embodiment of a home appliance implementing a hinge assembly of the present invention.

Example embodiments that incorporate one or more aspects of the present invention are described and illustrated in the drawings. These illustrated examples are not intended to be limitations on the present invention. For example, one or more aspects of the present invention can be utilized in other embodiments and even other types of devices.

FIG. 1 shows an example of an appliance 100 in which a hinge assembly 10 of the present invention can be implemented. The type of appliance 100 shown is an oven but the present invention may be applicable to any device with a compartment that is enclosed by a door 110 such as a dishwasher, a furnace, a rotisserie, a kiln, or the like. In such appliances, the door 110 is generally mounted adjacent the compartment using a pair of hinge assemblies 10 on each side of the bottom of the door 110 so that the door 110 is rotated upward for closing and is rotated downward for opening. Although the present embodiment adopts such an arrangement of the door 110, a person of ordinary skill will appreciate that the following description is equally applicable regardless of the orientation of the door 110 and the assembly 10. Other configurations of door rotation are, therefore, contemplated with this invention. For example, the door 110 may be rotated upward for opening and rotated downward for closing.

Figure 2:
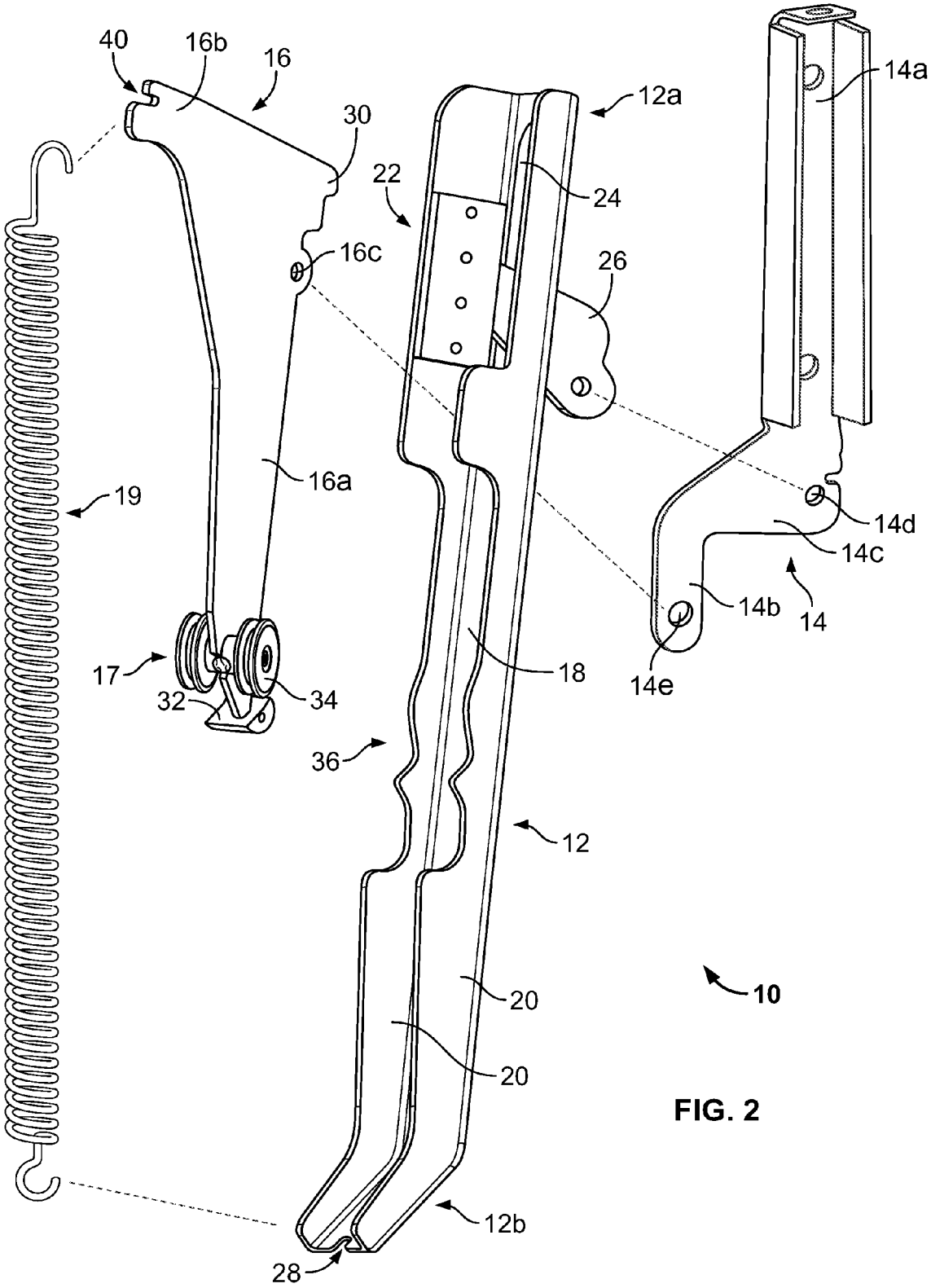
FIG. 2 is an exploded view of an example embodiment of the hinge assembly.

FIG. 2 shows an example embodiment of the hinge assembly 10 in accordance with the present invention. The hinge assembly 10 may include a housing member 12, a lever member 14, a traveling member 16 and a biasing member 19. Because FIG. 2 shows the hinge assembly 10 mounted on one side of the door 110, the hinge assembly 10 for the opposite side of the door 110 may have some parts that are not identical but mirror the parts shown in FIG. 2.

The housing member 12 is a structure that is mounted inside a body of the appliance 100 securing the hinge assembly 10 to the appliance 100 and has a substantially bracket-shaped cross section. The housing member 12 may be defined by a front wall 18 and two side walls 20 extending perpendicularly therefrom which combine to form a channel 22 extending along the length of the housing member 12. The side walls 20 may be parallel and may mirror one another in shape. The shape of the side walls 20 may have a certain geometry contributing to the operation of the hinge as will be described in more detail later. In a mounted state, the front wall 18 may be facing in the same direction as an opening 120 of the enclosed compartment, as shown in FIG. 1, whereas the side walls 20 may be oriented away from the opening 120 in a substantially rearward direction. Near one longitudinal end 12*a* of the housing member 12, which is configured to be the top end in this embodiment, the front wall may include an aperture 24 that allows a pivot 26 to project outward from the front wall 18 and is sized to provide room for the lever member 14 to pivot therein. In the present embodiment, the pivot 26 is formed by welding a plate to one of the side walls 20 in the channel near the aperture 24 although other means of attaching the pivot 26, such as by screws or nuts and bolts, are also contemplated. The pivot 26 may also be integrally formed on the housing member 12. As shown in FIG. 2, the side wall 20 on which the plate is attached may be asymmetrically larger as a result since the attached portion of the plate may need to extend over a sufficiently large area so that the attachment is rigid enough to endure repeated loading from opening/closing of the door. The shape of the aperture 24 may determine the extent to which the lever member 14 can pivot. The front wall 18 may also include one or more holes to accept fastening means, such as screws, or nuts and bolts, to secure the housing member 12 relative to the appliance 100. Near the other longitudinal end 12*b* of the housing member 12, which is configured to be the bottom end in this embodiment, the front wall 18 may be bent toward the interior of the compartment. The bottom end may be configured with a hole and/or a recess 28 to accommodate a first end of the biasing member 19 which may be hooked. In this embodiment, the biasing member 19 is a tension spring although any type of biasing means may also be used.

The lever member 14 is an elongate structure that is step-shaped in that the lever member 14 may include an outer portion 14*a* and an inner portion 14*b* which are both substantially straight and parallel but offset by an offsetting portion 14*c*. The outer portion 14*a*, the offsetting portion 14*c* and the inner portion 14*b* may be substantially straight. A first intermediate point 14*d* of the lever member 14 may be pivotally coupled to the pivot 26 projecting from the aperture 24. The first intermediate point 14*d* may be located at an area intersected by the outer portion 14*a* and the offsetting portion 14*c* in this embodiment. Once the first intermediate point 14*d* of the lever member 14 is pivotally coupled to the pivot 26, the outer portion 14*a* can rotate on the outer side of the housing member 12 while the inner portion 14*b* can rotate on the inner side of the housing member 12. The outer portion 14*a* of the lever member 14 is attached to the door 110 such that manipulation of the door 110 by a user is transmitted to the hinge assembly 10 causing movement of the parts. The shape of the offsetting portion 14*c* and the aperture 24 are configured to determine the extent of the rotation. For example, in the embodiment shown, a part of the offsetting portion 14*c*, which, if straight, would be caught by the aperture 24, is chamfered to enable clearance of the aperture 24 by the offsetting portion 14*c* and allow the lever member 14 to rotate until its rotation is restricted by the inner portion 14*b* contacting an upper end of the aperture 24. The interaction between the aperture 24 and the offsetting portion 14*c* arising from their shapes can thus be controlled and altered by a person of ordinary skill in the art to adjust the extent or manner of the door movement as desired.

The traveling member 16 is a link or plate that is configured to move along the length of the channel 22 on the inner side of the housing member 12. The traveling member 16 may include a main portion 16*a* a part of which extends along the housing member 12 during movement of the traveling member 16 caused by the rotation of the lever member 14. The traveling member 16 may also include an arm portion 16*b* that projects away from the main portion 16*a*. In this embodiment, the arm portion 16*b* projects rearward and upward from the main portion 16*a*, and the main portion 16*a* and the arm portion 16*b* give the traveling member 16 a substantially obtuse triangle shape. An end 14*e* of the inner portion 14*b* of the lever member 14 may be pivotally coupled to the traveling member 16 at a second intermediate point 16*c* that is located at an intermediate area of the main portion 16*a*. The coupling transmits the rotation of the lever member 14, arising from manipulation of the door 110 by a user, to the traveling member 16 causing displacement of the traveling member 16 substantially up and down the channel 22. A projection 30 near a top end of the main portion 16*a* limits the rotation of the lever member 14 during closing such that the lever member 14 stops rotating when the projection 30 contacts the front wall 18.

Figure 5A:
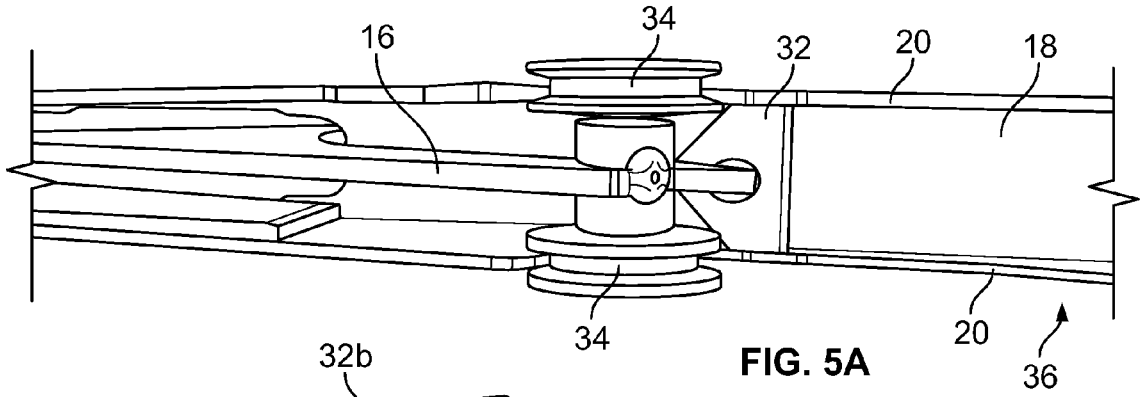
FIG. 5A is a close-up, top view of an end of a traveling member with a pair of wheels and a sliding block placed on the rail area of side walls of the housing member.
Figure 5B:
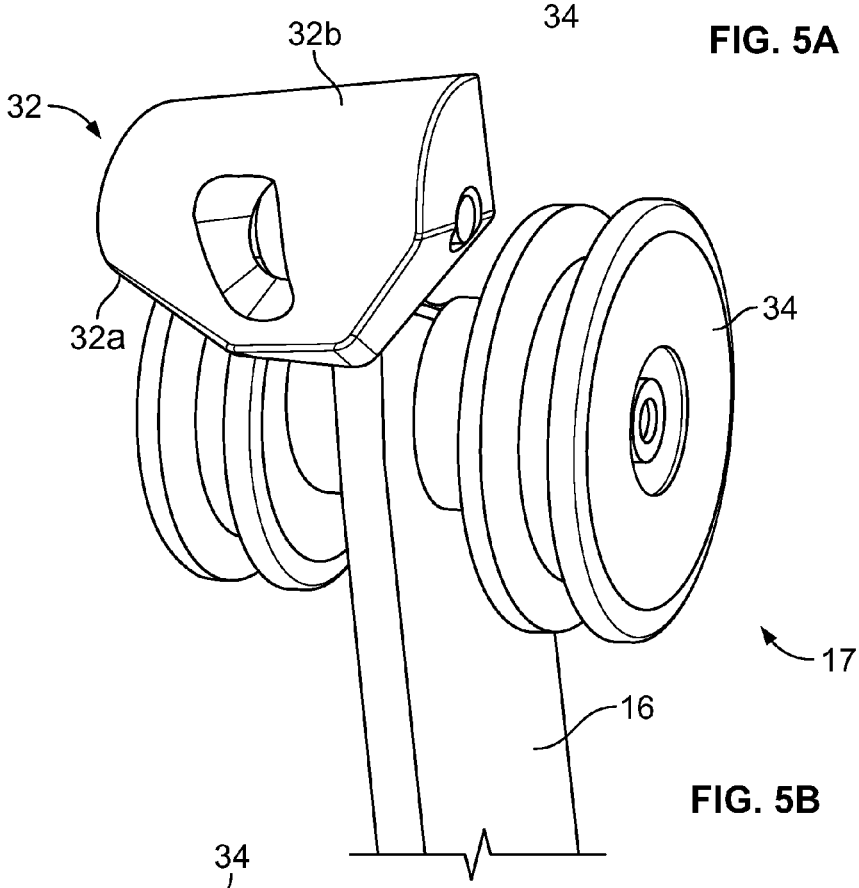
FIG. 5B is a close-up, perspective view of the end of the traveling member with the pair of wheels and the sliding block.

As shown in FIGS. 5A and 5B, the bottom end 17 of the main portion 16*a* may include a sliding block 32 that is configured to slide along the channel 22 between the side walls 20 of the housing member 12. The sliding block 32 is dimensioned to have a sliding fit about the side walls 20 and may take on a variety of shapes. The present embodiment of the sliding block 32 is substantially a semi-cylinder with chamfers 32*a* that are cut out to provide room for adjacent wheels 34. The round portion 32*b* of the sliding block 32 may ease the movement of the sliding block 32 in case the sliding block 32 rubs against the front wall 18 of the housing member 12 during movement within the channel 22 although the sliding block 32 may be configured to not make contact with the front wall 18. The sliding block 32 may be attached to the bottom end 17 of the traveling member 16 by inserting a pin through the traveling member 16 and the sliding block 32. The sliding block 32 may be made of material that can withstand some degree of abrasion such as polymer.

The bottom end 17 of the main portion 16*a* may also include a pair of grooved wheels 34 that are configured to roll along the housing member 12 using the side walls 20 as rails. The grooved wheels 34 may be rotatably coupled to an axle mounted on the bottom end 17 of the main portion 16*a*. The wheels 34 may also be made of material that can withstand some degree of abrasion such as polymer.

Figures 3A, 3B, 3C:
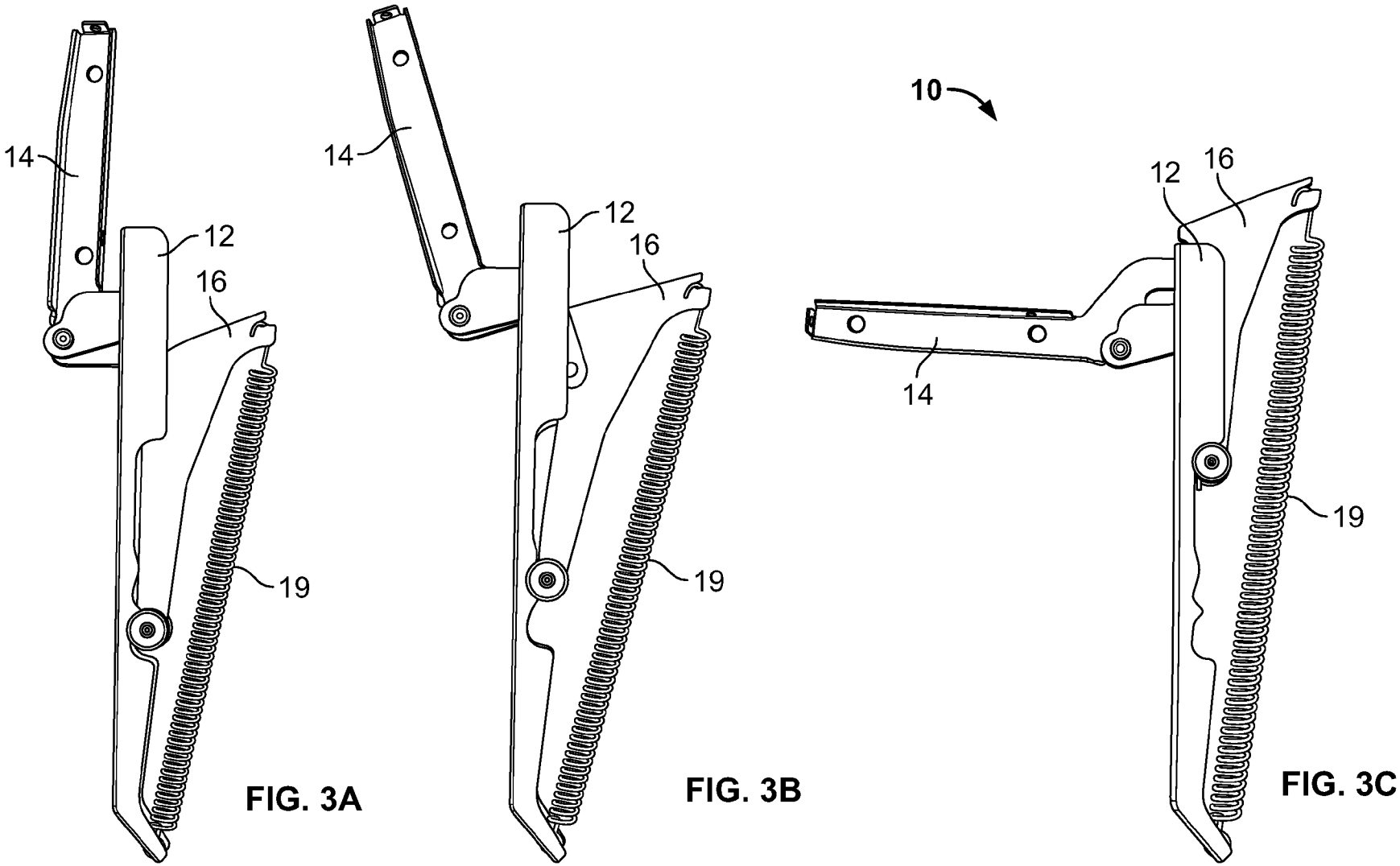
FIG. 3A is side view of the hinge assembly in a closed position.
FIG. 3B is a side view of the hinge assembly in a partially opened position.
FIG. 3C is a side view of the hinge assembly in an open position.
Figure 4:
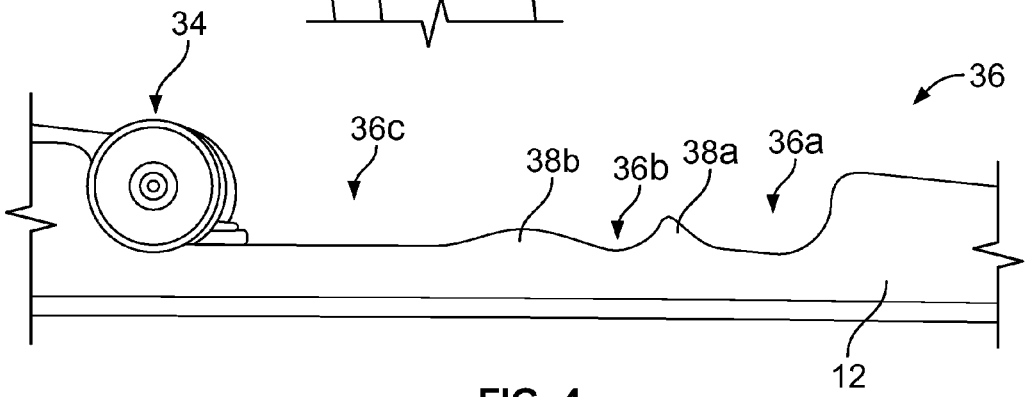
FIG. 4 is a close-up, side view of a rail area of a housing member of the hinge assembly.

A part of the side walls 20 of the housing member 12 may include a cammed portion that defines a rail area 36 and forms a path for the grooved wheels 34 such that the grooved wheels 34 undergo vertical and horizontal movement in a predetermined kinematic manner as the grooved wheels 34 roll against the rail area 36 of the side walls 20. The rail area 36 may be formed by carving out a part of the side walls 20, molding the side walls 20 in a desired shape or other means known in the art for processing the material from which the hinge assembly 10 is made such as metal, polymer or the like. The rail area 36 may be thus a portion of the side walls 20 with a height that is lower than adjacent portions of the side walls 20 and may determine the range of movement of the grooved wheels 34 in addition to the interaction between the aperture 24, the projection 30, and the offsetting portion 14*c*. As shown in FIG. 4, the shape of the rail area 36 is configured to not only affect the range of door rotation but also form at least one detent position during the opening and closing of the door 110. In the present embodiment, the rail area 36 includes a first area 36*a* for a closed door position (FIG. 3A), a second area 36*b* for a partially opened door position (FIG. 3B), which is commonly used as the "broil" position, and a third area 36*c* for positions of a freely rotating door (FIG. 3C), including a fully opened door position. In this embodiment, the first area 36*a* and the second area 36*b* provide two detent positions which are divided by a high peak 38*a* of the cammed portion, while the second area 36*b* and the third area 36*c* are divided by a low peak 38*b* of the cammed portion. The difference in elevations of the peaks 38*a*, 38*b* makes the transition between the first area 36*a* and the second area 36*b* more difficult in that the door 110 must be manipulated with more force to switch between the closed position and the partially opened position than to switch between the second area 36*b* and the third area 36*c*, i.e., the partially opened position and the positions for a freely rotating door.

The end of the arm portion 16*b* includes a hole/recess 40 that is configured to accommodate a hooked end of the biasing member 19. Thus, the biasing member 19 extends from the recess 40 at the end of the arm portion 16*b* to the hole/recess at the bottom end 12*b* of the housing member 12 and is configured to bias the traveling member 16 close to the bottom end 12*b* of the housing member 12 thereby maintaining the door 110 in a closed position. Moreover, the tension in the biasing member 19 that is created when the door 110 is opened helps maintain the grooved wheels 34 in the partially opened door position. Combined with the force from the biasing member 19, the coupling at the second intermediate point 16*c* between the end of the inner portion 14*b* of the lever member 14 and the intermediate area of the main portion 16*a* of the traveling member 16 causes the end 14*e* to move in a circular path and the traveling member 16 to undergo some angular rotation as the traveling member 16 travels up and down the housing member 12. This is because the biasing member 19 biases the bottom end 17 of the main portion 16*a* against the rail area 36 such that the sliding block 32 does not escape from between the side walls 20, and the wheels 34 are sufficiently pressed against the side walls 20 thereby avoiding derailment during door rotation.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A hinge assembly for a door enclosing a compartment, including:

a housing member configured to be mounted in the compartment, the housing member including a front wall and two side walls extending rearward from the front wall, the front wall and the side walls defining a channel, the housing member further including a top end and a bottom end;

a traveling member configured to extend substantially along the housing member, wherein the traveling member includes a sliding block and at least one wheel at a first end, the sliding block configured to travel the channel sliding between the side walls, at least one of the side walls including a rail area for the at least one wheel to roll along; and a biasing element extending between a second end of the traveling member and the bottom end of the housing member.

2. The hinge assembly of claim 1, wherein the traveling member includes a pair of the wheels which is oppositely arranged and each of which is configured to lie over one of the side walls, and wherein each wheel travels along the corresponding rail area formed on each of the side walls.

3. The hinge assembly of claim 2, wherein the rail area is defined by a cammed portion of the side walls with a height lower than adjacent portions of the side walls.

4. The hinge assembly of claim 3, wherein the rail area defines in order at least a first area for a closed door position, a second area for a partially opened door position, and a third area for a third door position.

5. The hinge assembly of claim 4, wherein the first area and the second area are divided by a first peak of the cammed portion, the second area and the third area are divided by a second peak of the cammed portion, and the first peak is greater in height than the second peak.

6. The hinge assembly of claim 1, wherein the wheels roll along the side walls along the rail area of the side walls as the door moves from an open position to a closed position.

7. The hinge assembly of claim 1, wherein the sliding block is dimensioned to fit slidingly between the side walls.

8. The hinge assembly of claim 7, wherein the sliding block is a semi-cylinder with chamfered corners.

9. The hinge assembly of claim 1, wherein the front wall includes an aperture near the top end and the housing member further includes a pivot projecting forward from the aperture.

10. The hinge assembly of claim 9, further comprising a lever member including an outer portion and an inner portion, an intermediate point located between the outer portion and the inner portion, the lever member pivotally coupled to the pivot at the intermediate point, the outer portion configured to be mounted on the door and transmit the movement of the door to the hinge assembly.

11. A hinge assembly for a door enclosing a compartment, including:

a housing member configured to be mounted in the compartment, the housing member including a front wall and two side walls extending rearward from the front wall, the housing member further including a top end and a bottom end, the front wall and the side walls defining a channel, the front wall including an aperture near the top end, the housing member further including a pivot projecting forward from the aperture;

a lever member including an outer portion and an inner portion, a first intermediate point located between the outer portion and the inner portion, the lever member pivotally coupled to the pivot at the first intermediate point, the outer portion configured to be mounted on a door and transmit the movement of the door to the hinge assembly;

a traveling member including a main portion and an arm portion, the main portion configured to extend substantially along the housing member, the main portion including a first end, the arm portion including a second end, a second intermediate point located on the main portion, the inner portion of the lever member pivotally coupled to the second intermediate point, the main portion including at least one wheel at the first end, at least one of the side walls including a rail area for the at least one wheel to roll along, the rail area defined by a cammed portion of the side walls with a height lower than adjacent portions; and a biasing element extending between a second end of the arm portion and the bottom end of the housing member.

12. The hinge assembly of claim 11, wherein the traveling member includes a pair of oppositely arranged, grooved wheels each of which is configured to lie over one of the side walls, and wherein each wheel travels along the rail area formed on each of the side walls.

13. The hinge assembly of claim 11, wherein the rail area defines in order at least a first area for a closed door position, a second area for a partially opened door position, and a third area for a third door position.

14. The hinge assembly of claim 13, wherein the first area and the second area are divided by a first peak of the cammed portion, the second area and the third area are divided by a second peak of the cammed portion, and the first peak is greater in height than the second peak.

15. The hinge assembly of claim 11, wherein the traveling member includes a pair of the wheels, each of which is configured to roll along one of the side walls along the rail area of the corresponding side wall as the door moves from an open position to a closed position.

16. The hinge assembly of claim 11, wherein the main portion further includes a sliding block that is configured to travel the channel sliding between the side walls and is dimensioned to fit slidingly between the side walls.

17. The hinge assembly of claim 16, wherein the sliding block is a semi-cylinder with chamfered corners.

18. A hinge assembly for a door enclosing a compartment, including:

a housing member configured to be mounted in the compartment, the housing member including a front wall and two side walls extending rearward from the front wall, the housing member further including a first end and a second end, the front wall and the side walls defining a channel;

a lever member pivotally coupled to the housing member and configured to transmit the movement of the door to the hinge assembly;

a traveling member including a main portion and an arm portion, the main portion configured to extend substantially along the housing member, the main portion including a third end, the arm portion including a fourth end, an intermediate point located on the main portion, the inner portion of the lever member pivotally coupled to the intermediate point, the main portion including a sliding block and a pair of wheels at the third end, the sliding block configured to travel the channel sliding between the side walls, each of the side walls including a rail area for each of the wheels to roll along; and a biasing element extending between the fourth end of the arm portion and the second end of the housing member.

19. The hinge assembly of claim 18, wherein the rail area is defined by a cammed portion of the side walls with a height lower than adjacent portions of the side walls.

20. The hinge assembly of claim 18, wherein the rail area defines in order at least a first area for a closed door position, a second area for a partially opened door position, and a third area for a third door position.

21. The hinge assembly of claim 20, wherein the first area and the second area are divided by a first peak of the cammed portion, the second area and the third area are divided by a second peak of the cammed portion, and the first peak is greater in height than the second peak.

* * * * *